United States Patent [19]

Fredriksson

[11] 4,062,254

[45] Dec. 13, 1977

[54] DEVICE FOR TIGHTENING, PRESTRESSING AND UNTIGHTENING A THREADED JOINT

[75] Inventor: Roland Fredriksson, Motala, Sweden

[73] Assignee: AB Motala Verkstad, Motala, Sweden

[21] Appl. No.: 712,773

[22] Filed: Aug. 9, 1976

[30] Foreign Application Priority Data

Aug. 11, 1975 Sweden ..... 7508991

[51] Int. Cl.[2] ..... B25B 29/02

[52] U.S. Cl. ..... 81/57.38

[58] Field of Search ..... 81/57.38; 254/29 A

[56] References Cited

U.S. PATENT DOCUMENTS 3,230,799 1/1966 Maciulaitis ..... 81/57.38

*Primary Examiner*—James L. Jones, Jr.

*Attorney, Agent, or Firm*—Henry R. Lerner

[57] ABSTRACT

A device for tightening, prestressing and untightening a threaded joint has a body for mounting around a nut in the joint. The body is provided with pistons, actuated by pressure medium for providing an elastic elongation of a screw in the joint. Inclined planes are arranged to convert the axial movement of the pistons to a turning movement for turning the nut thereby achieving tightening or untightening of the threaded joint. The angle of the inclined planes are so adjusted that there is a suitable relationship between axial force and torque.

6 Claims, 11 Drawing Figures

DEVICE FOR TIGHTENING, PRESTRESSING AND UNTIGHTENING A THREADED JOINT

The present invention relates to a device for tightening, pretensioning and untightening a threaded joint in a simple and reliable way with great accuracy with regard to the amount of pretensioning.

When tightening a threaded joint where a definite amount of pretensioning in the threaded joint is required, there have been great difficulties in obtaining an accurately determined pretensioning force. Tightening of the threaded joint with a certain torque with some kind of torque wrench is not sufficiently reliable since friction between the threads in screw and nut and between nut and substructure vary to a great degree, depending among other things on the design of the joint.

From the Swedish published specifications Nos. 332,948, 332,329 and 360,714, it is known to pretension threaded joints with the help of a pressure medium, and from the Swedish published specification Nos. 343,006, it is known to tension a nut by means of an annular jack. Finally, the Swedish Pat. No. 7316955-9 shows a device for erecting and taking down a radially and axially pretensioned threaded joint.

The invention now proposed relates to a device for reliably pretensioning a threaded joint, where large demands are placed on accuracy of the pretensioning force and where pretensioning is made possible in a simple and timesaving way.

Figure 1:
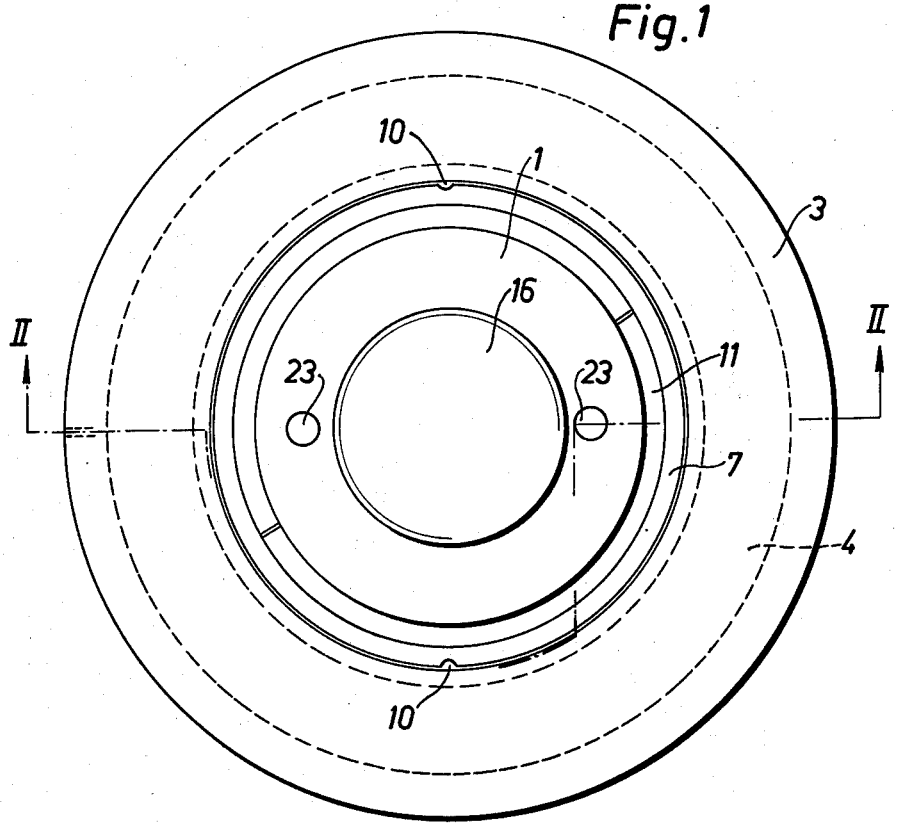
Figure 2:
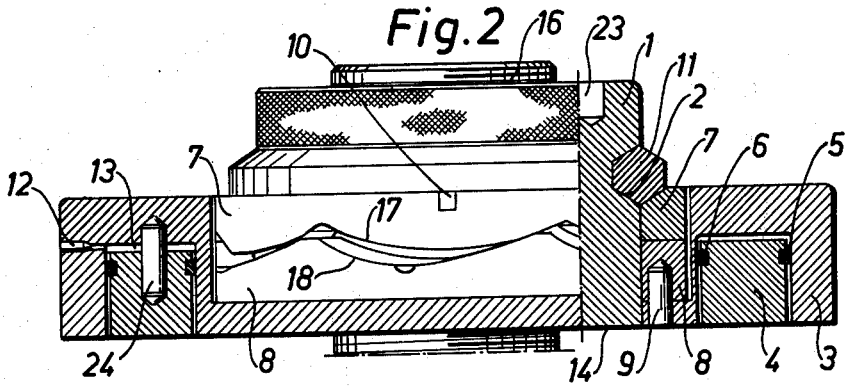
Figure 3:
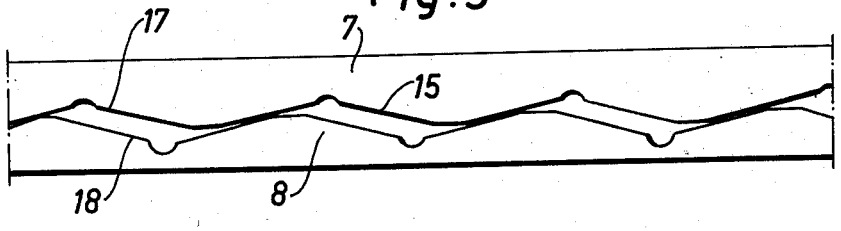

The invention will now be more fully described while referring to the attached drawings, wherein FIG. 1 is a plan showing the device fitted to a nut, FIG. 2 shows a section along the line II-II in FIG. 1 through the pretensioning device and through a portion of the nut, FIG. 3 shows schematically a position during tightening for a pair of toothed rings incorporated in the device.

Figure 4:
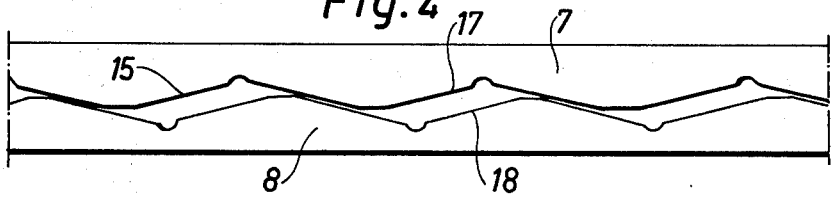
Figure 5:
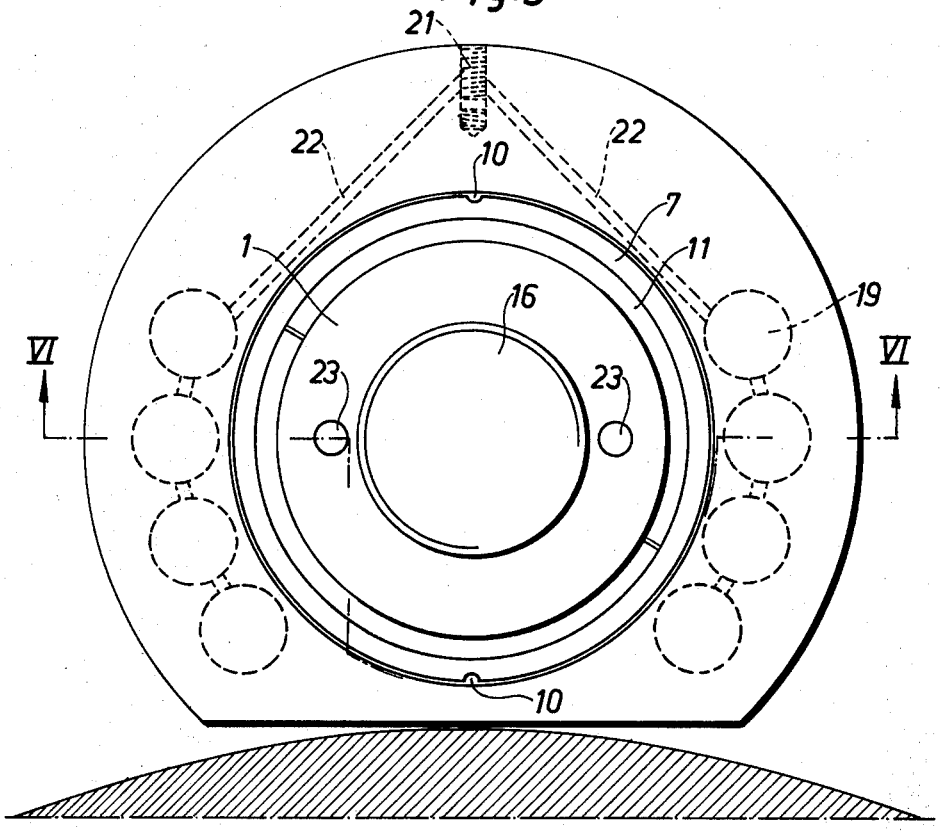
Figure 6:
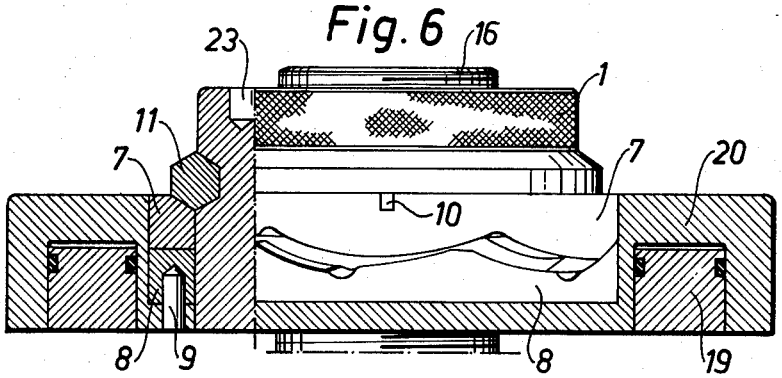

FIG. 4 is a view similar to FIG. 3 but showing a position for these rings during untightening, FIG. 5 shows a plan of a modified form of the pretensioning device for pretensioning a flange joint and FIG. 6 shows a section along the line VI-VI in FIG. 5 through the pretensioning device and nut.

A cylindrical nut 1 is provided on the upper portion thereof with a groove 2 for transmitting the moment achieved by a pretensioning device and for taking up the axial prestressing force.

A prestressing device surrounds nut 1 and consists of a body 3, an annular piston 4 with sealing rings 5, 6, a dowel 24 for locating the piston in relation to the body 3, an upper toothed ring 7 and a lower toothed ring 8 and a number of dowels 9 for locating the lower toothed ring 8 in relation to the body 3. The toothed rings 7 and 8 are made with complementary engaging sloping planes 17 and 18, respectively, with a certain inclination 15. This inclination is the same for both toothed rings and is so adjusted that a tangential force is provided which can turn the nut 1 on a screw 16. This entails that the inclination 15 must be large enough for the friction between the contact surfaces of the toothed rings and the friction between the threads in a screw 16 and a nut 1 to be overcome. The inclination 15 may however not be so large that the tangential force inhibits self-locking between the nut 1 and a parted ring 11 arranged in the groove 2 and in the upper toothed ring 7. The nut 1 is provided with recesses 23 accommodating pins on a tool for manually turning the nut. The upper toothed ring 7 is provided with notches 10, likewise intended for a tool when turning manually. The parted ring 11 is provided for the purpose of transmitting torque and axial force from the prestressing device to the nut.

When tightening the joint against the plane 14 the nut 1 is to engage with, the prestressing device is mounted around the nut 1 and the parted ring is fitted into the groove 2 on the nut 1. By using a swan-neck wrench with pegs fitting the notches 10, the upper toothed ring 7 is turned counter-clockwise (for a right-hand threaded screw) until engagement is obtained between the upper portion of the toothed ring and the parted ring 11. The torque set up by hand with the wrench is maintained and pressure medium is taken by a connection 12 into an intermediate space 13 between the body 3 and the piston 4, whereby the body 3 with the toothed rings 7 and 8 is given an axial movement towards the parted ring 11. The pressure from the pressure medium is transferred through the ring 11 to the nut 1, and provides via the latter a stress on and thereby an elongation of the screw 16.

The axial force from the pressure medium on the piston 4 passes over into a tangential force when the nut 1 is lifted up from the plane 14, which turns the nut 1 by the toothed ring 7 turning relative to the toothed ring 8, because the contact between the nut 1 and the plane 14 has ceased and thereby the frictional resistance between them also, whereat the nut 1 is tightened.

When untightening the joint the same procedure is carried out as for tightening, but the upper toothed ring is turned in the opposite direction to that for tightening. Because of the thread gradients, the tangential force required for untightening will be less than the corresponding force required for tightening.

In the joint shown in FIGS. 5 and 6, where there is not room for a continuous annular piston 4 in the body 3, e.g. in a shaft connection with flanges, a number of separate pistons 19 are arranged in a body 20. The pistons communicate with each other and are actuated by a common pressure medium which is supplied from a common inlet 21 through canals 22.

The invention is not limited to what has been shown in the embodiments here, but can be varied in a wider sense within the scope of the patent claims.

What is claimed is:

1. A device for tightening, prestressing and untightening a threaded joint where great prestressing accuracy is required comprising, a body having an opening therein for receiving an elongated internally threaded member forming part of said joint, pressure actuated piston means in said body adapted to impart axial movement thereto, and means having inclined surfaces carried by said body for converting said body axial movement into rotational movement of an elongated threaded member received in said body for tightening or untightening the threaded joint.

2. A device as claimed in claim 1, wherein said means having inclined surfaces comprise a lower ring supported on said body and an upper ring supported on said lower ring, the inclined surfaces on said rings being in mutually confronting relation.

3. A device as claimed in claim 2, wherein said piston means comprise an annular member concentrical about the centerline of the joint.

4. A device as claimed in claim 2, wherein said piston means comprise a plurality of pistons mounted circumferentially about the centerline of the joint.

5. A device as claimed in claim 4, wherein said pistons are in fluid communication with each other and wherein said body is provided with a plurality of canals in communication with said pistons, said canals being in communication with a single inlet for supplying a pressure medium through said canals to said pistons.

6. A device as claimed in claim 2, wherein said elongated threaded member is provided with a circumferential groove adapted to receive a parted ring, said parted ring being in engagement with said upper ring whereby the tangential and axial force on said upper ring is transmitted to said elongated threaded member through said parted ring.

* * * * *